United States Patent [19]

McConnell

[11] 4,250,365

[45] Feb. 10, 1981

[54] CURRENT INTERRUPTER FOR FAULT CURRENT LIMITER AND METHOD

[75] Inventor: Lorne D. McConnell, Chalfont, Pa.

[73] Assignee: Electric Power Research Institute, Inc., Palo Alto, Calif.

[21] Appl. No.: 889,491

[22] Filed: Mar. 22, 1978

[51] Int. Cl.[3] ..... H01H 33/68

[52] U.S. Cl. ..... 200/150 R; 200/144 AP; 200/149 A; 200/150 B; 200/150 D

[58] Field of Search ..... 200/144 AP, 149 R, 149 A, 200/150 R, 150 A, 150 B, 150 D, 150 F, 150 L, 150 M, 61.08

[56] References Cited

U.S. PATENT DOCUMENTS

| | | | |
|---|---|---|---|
| 2,049,328 | 7/1936 | Skeats | 200/150 D |
| 3,129,307 | 4/1964 | DeVargas | 200/149 A X |
| 3,264,438 | 8/1966 | Gay | 200/61.08 X |
| 3,590,191 | 6/1971 | Kind et al. | 200/150 B |
| 3,704,391 | 11/1972 | McConnell | 200/144 AP |
| 3,728,505 | 4/1973 | McConnell | 200/144 AP |
| 3,902,031 | 8/1975 | McConnell | 200/150 G X |
| 3,909,676 | 9/1975 | McConnell | 200/144 AP X |
| 3,927,350 | 12/1975 | McConnell | 200/144 AD X |
| 4,034,175 | 7/1977 | Gratzmuller | 200/150 R |

OTHER PUBLICATIONS

Fuji Electric Co. Ltd., Fuji Publication EEC 65, "Fuji Indoor Use Ultrap Fuse", pp. 1-6.

*Primary Examiner*—James R. Scott
*Attorney, Agent, or Firm*—Flehr, Hohbach, Test, Albritton & Herbert

[57] ABSTRACT

A current interrupter is provided for use in controlling currents associated with power line faults. The interrupter is of the type having a housing filled with a dielectric fluid such as pressurized sulfur hexafluoride liquid and having electrodes extending through the walls of the housing. Associated with the electrodes is a movable contact member which when closed provides a path for current flow and which is movable to break a circuit. The housing includes a fluid chamber having a passage for fluid communication with the remaining interior of the housing. The movable contact member closes the passage when in its closed position. The method of the invention includes rapidly increasing the pressure in the chamber to move the contact from its closed position. A chemical propellant drives a piston against the fluid in the chamber. The fluid drives the movable contact member to open the passage and to break the current path, causing an arc. The fluid escaping from the chamber flows transverse to the arc thereby increasing the voltage drop of the interrupter.

9 Claims, 9 Drawing Figures

CURRENT INTERRUPTER FOR FAULT CURRENT LIMITER AND METHOD

BACKGROUND OF THE INVENTION

This invention relates to current interrupters of the type used in controlling fault currents associated with transmission lines in power distribution systems. More particularly, the invention relates to such interrupters employing a housing filled with a dielectric fluid.

Fast-acting current interrupters are used on power distribution lines for current limiting purposes. Fault currents on high voltage lines, due to ground shorts, for example, can rapidly become enormous and cause serious equipment damage. As transmission voltages rise, there is a continuing need in the electric power industry for improved current interrupting devices and methods for use in rapidly controlling fault currents.

Current limiting circuits employ interrupter switches which open to divert a fault current through an associated current-suppressive impedance which limits the current to a safe level. A common feature of most types of interrupters is that arcing occurs between the electrodes when the contacts are opened. Since the arc will carry substantially the full fault current, the voltage drop between the arcing electrodes must be large to successfully divert the fault current into a parallel impedance. It is known that submerging the arcing electrodes in a dielectric medium can increase the voltage drop. However, the large amounts of energy released by arcing electrodes can vaporize or otherwise reduce the effectiveness of dielectric fluids.

Rapid separation of the contact electrodes is desirable to prevent damaging current increases. Mechanical or magnetic actuating means for separating electrodes generally take on the order of two milliseconds to effect separation. Mechanical-type actuators also have the associated problems of contact bounce and generally high cost. Chemical explosives have been used to break contacts to effect rapid breaking of a circuit. A problem which arises when explosive charges are employed to fracture or break current-carrying material is that the resultant arcing gap is non-uniform and fragmented. This leads to numerous sharp edges and other surface features which can result in an efficient arcing environment, producing a low voltage drop between the electrodes. Furthermore, such destructive use of explosives generally renders the device non-reusable.

OBJECTS AND SUMMARY OF THE INVENTION

It is an object of the invention to provide a current interrupter and method for use in a current limiting circuit which is fast-acting and causes a large voltage drop between the arcing electrodes.

Another object of the invention is to provide such an interrupter and method which employs chemical propellants to separate the electrodes.

Another object of the invention is to provide such an interrupter and method which produces a strong transverse flow of dielectric fluid across the arcing gap.

Accordingly, a current interrupter is provided for use in controlling currents associated with power line faults. The interrupter includes a housing and a pair of electrode members in the housing. A contact member is supported for movement in the housing and is movable between a closed position and an open position. In the closed position the contact member contacts the pair of electrode members to provide a conductive path between the electrodes. In the open position the contact member is separated from at least one of the electrode members. A chamber is provided in the interior of the housing for holding a dielectric fluid. There is a passage between the chamber and the interior of the housing. The contact member blocks and closes the passage when in its closed position. The interrupter further includes means in the housing for rapidly increasing fluid pressure in the chamber to move the contact member from the closed position to the open position by means of fluid pressure. The method of the invention used by the interrupter includes increasing the fluid pressure in the chamber by an amount sufficient to drive the contact member from the closed position. The increased pressure separates the contact member from at least one of the electrode members, opening the interrupter. The fluid is then caused to escape the chamber through the passage by way of transverse flow through the gap separating the contact member and the at least one electrode member from which it is separated. An arc in the gap is thus subjected to a transverse flow of dielectric fluid.

DESCRIPTION OF THE PREFERRED EMBODIMENT

Figure 1:
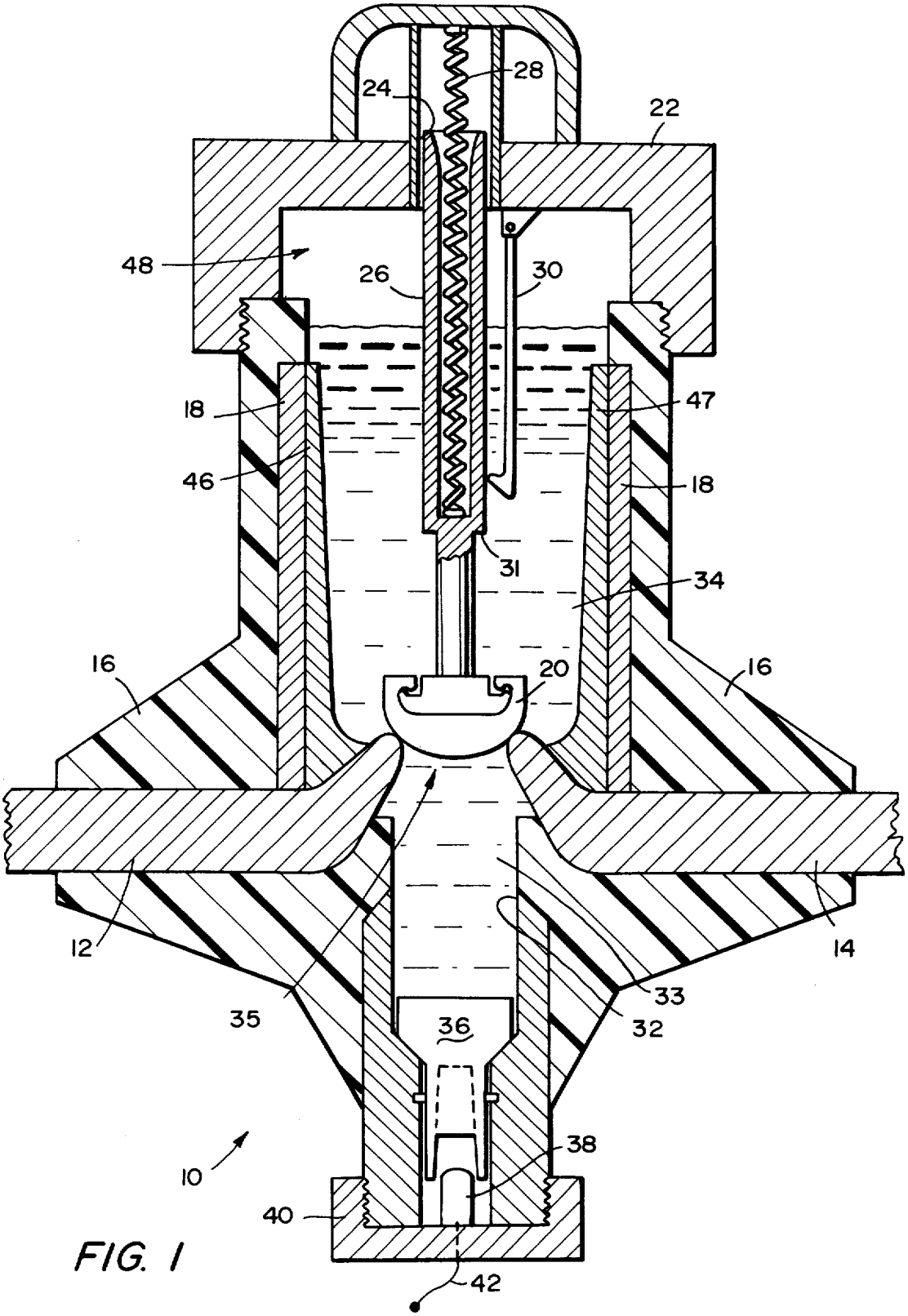
FIG. 1 is a cross-sectional view of a current interrupter according to the invention.

Referring to FIG. 1, a first embodiment of a current interrupter 10 is shown with a pair of electrode members 12 and 14 fixed in spaced relation and extending through the wall of housing 16. The housing 16 is preferably formed of a cast electrically insulating material such as epoxy and includes reinforcing members 18 for added strength. A contact member 20 is supported for movement in the housing by top portion 22. The movable support for contact 20 includes a bearing surface 24 against which contact support rod 26 slidably engages. Internal spring means 28 in support 26 is biased to exert downward pressure. Contact member 20 is thereby urged into a closed position to form a bridging contact between electrodes 12 and 14 to provide a conductive path therebetween. Latch member 30 is biased against support rod 26 to engage a shoulder 31 when movable contact 20 is moved upwardly to a fully open position.

In the lower portion of housing 16 there is provided a fluid chamber 32 which is substantially filled with a dielectric fluid 33 of a suitable type such as oil or liquid sulfur hexafluoride ($SF_6$). The remaining interior 34 of housing 16 also contains the same dielectric fluid. A passage 35 is provided between chamber 32 and the remaining interior 34 of housing 16, forming an outlet from the chamber. Passage 35 extends between electrodes 12 and 14. Contact member 20 blocks and closes passage 35 when in its closed position, being in contact with the liquid in chamber 32, as shown in FIG. 1. A movable piston 36 in the lower portion of chamber 32 provides means in the housing for rapidly increasing the pressure of the liquid in the chamber. To drive piston 36, a chemical propellant charge is disposed between piston 36 and bottom cap 40 of housing 16. Propellant 38 can be any suitable chemical explosive of the type which can readily be detonated by a signal on wire 42 which extends through cap 40. An example of such an explosive would be a firing cap.

In the upper portion of housing 16, above electrodes 12 and 14, arc runners 46 and 47 are provided to control the spread of the arcs. To help increase the voltage drop of the interrupter, arc runners 46 and 47 can be made of a non-linear resistance material which increases resistivity with heating, as is well known in the art. As noted above, the housing and chamber 32 are substantially filled with dielectric fluid. If liquid $SF_6$ is used, the housing is hermetically sealed and pressurized to 300–800 p.s.i. to place the $SF_6$ into a liquid state. A gas pocket 48 is left in the top of the housing to permit expansion.

In operation, the first embodiment interrupter shown in FIG. 1 is installed on line in a power distribution system. The external portion of electrodes 12 and 14 are connected to a power line. A current-suppressive impedance (not shown) is connected in parallel with the interrupter. When the contact member 20 is in its closed position, as shown in FIG. 1, current flows between electrodes 12 and 14 by way of contact 20 and no current passes through the parallel impedance. When a line fault occurs, by way of a subtantial current path to ground, for example, the current through interrupter 10 rises rapidly. Apparatus (not shown) continuously monitors the line current to detect such a rapid current rise, indicating a fault. When a fault is detected the monitoring apparatus sends a signal over wire 42 to detonate propellant 38.

Figure 2:
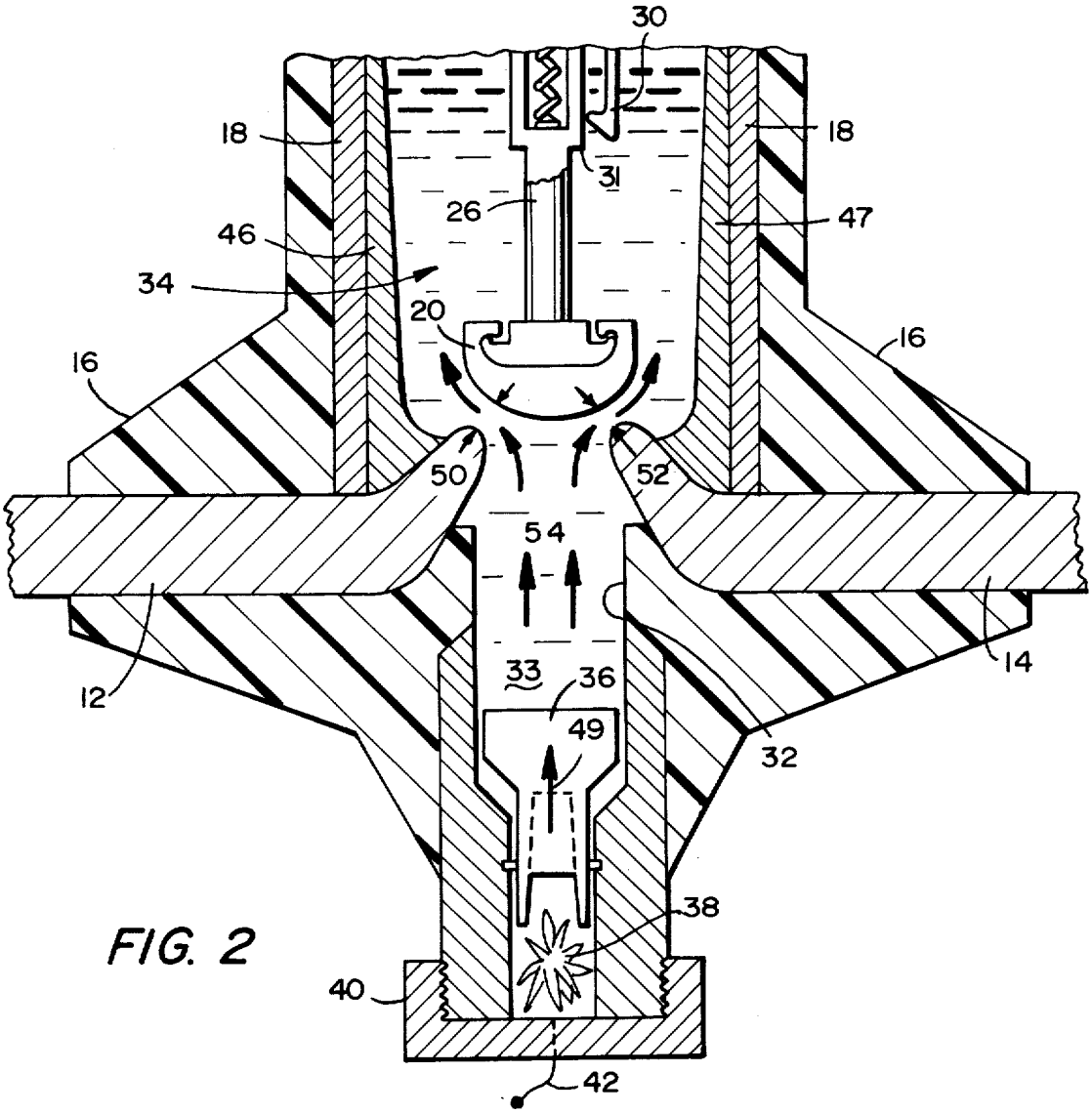
FIG. 2 is a partial view of the interrupter of FIG. 1 showing the operation of the interrupter.
Figure 3:
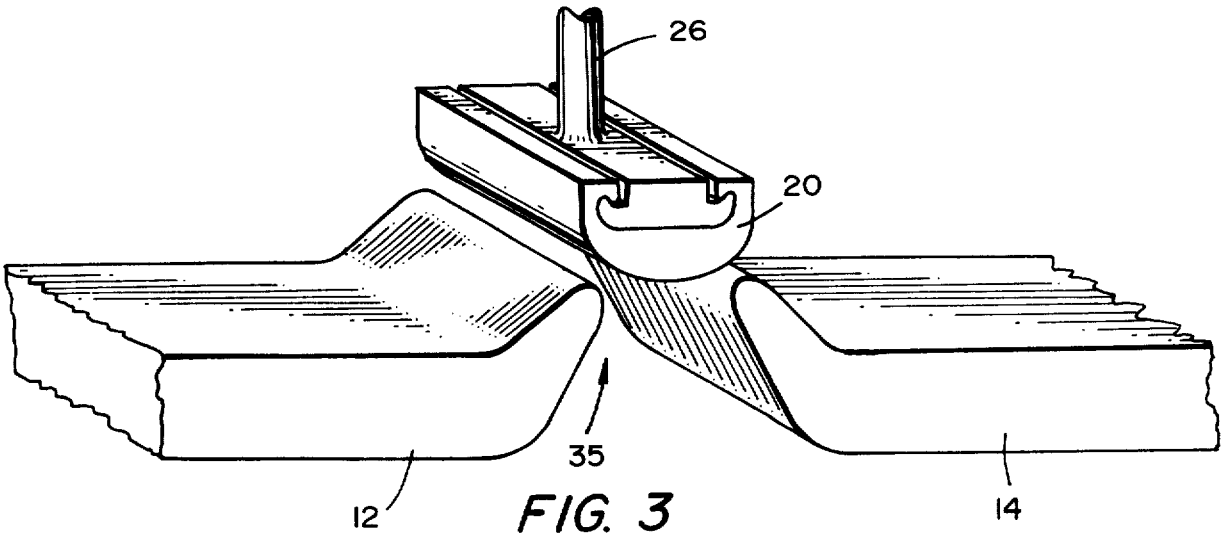
FIG. 3 is a perspective view of the electrodes and contact member of the interrupter shown in FIG. 1.

The method of opening the interrupter of this invention is shown most clearly in FIG. 2. The igniting of propellant 38 causes piston 36 to be rapidly driven upward as indicated by arrow 49 against the liquid 33 in chamber 32. This causes an enormous increase in the pressure of the liquid which is immediately transmitted against contact 20 by the liquid. The pressure is increased by an amount sufficient to overcome the bias of spring 28 and drive contact 20 from its closed position, separating it from both electrodes 12 and 14 and opening passage 35. Arcs appear in the intervening gaps 50 and 52 separating the electrodes and the movable contact. As shown in FIG. 3, the gaps extend between the elongated surfaces along which the electrodes and contact 20 meet. Immediately following separation, the arcs continue to carry substantially the full fault current. Once the passage is opened, the liquid flows out of chamber 32 through passage 35, by way of transverse flow across the arcing gaps 50 and 52 as indicated by arrows 54.

Both the dielectric properties of the liquid and the strong transverse fluid flow produce a rapid rise in the voltage drop between the arcing electrodes. As such, the fault current through interrupter 10 is rapidly diverted into the parallel current-suppressive impedance, which then controls the fault current. Under normal operating conditions, the arcs in gaps 50 and 52 will continue to burn, perhaps extending to adjacent arc runners 46 and 47, until a normal current zero in the alternating current cycle, at which time the arcs will disappear. As the arc runners are heated by the arc, they increase in resistivity thereby increasing the voltage drop of the interrupter. Latch 30 prevents movable contact 20 from returning to its closed position, once the contact is fully opened. The dielectric liquid provides high withstand characteristics which prevent arc re-ignition in the presence of substantial recovery voltages.

The current interrupter of FIGS. 1-3 takes advantage of the pressure-transmitting properties of the dielectric liquid to effect rapid electrode separation. The use of a chemical propellant as the driving force insures both rapid operation and high pressures. The construction provides for a strong crossflow of dielectric liquid at right angles to the resultant arcs which helps cool the electrodes and increases the voltage drop between the arcing electrodes. The interrupter is completely safe, with the explosion fully contained within the housing. Furthermore, the interrupter is reusable with only replacement of the chemical propellant and the contact head 20, and the resetting of movable contact 20 required.

Figure 4:
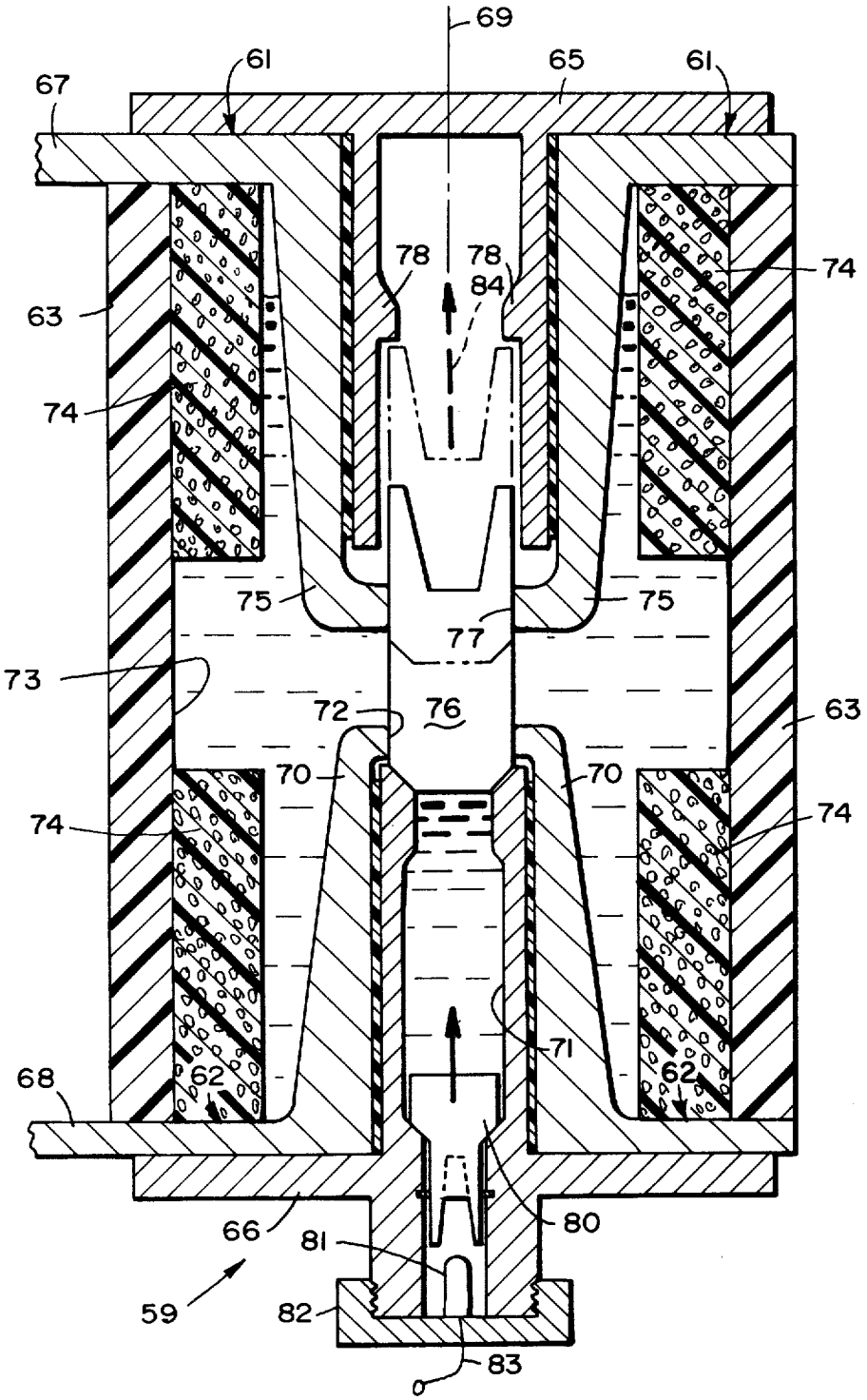
FIG. 4 is a cross-sectional view of an alternative embodiment of the interrupter of FIG. 1.
Figure 5:
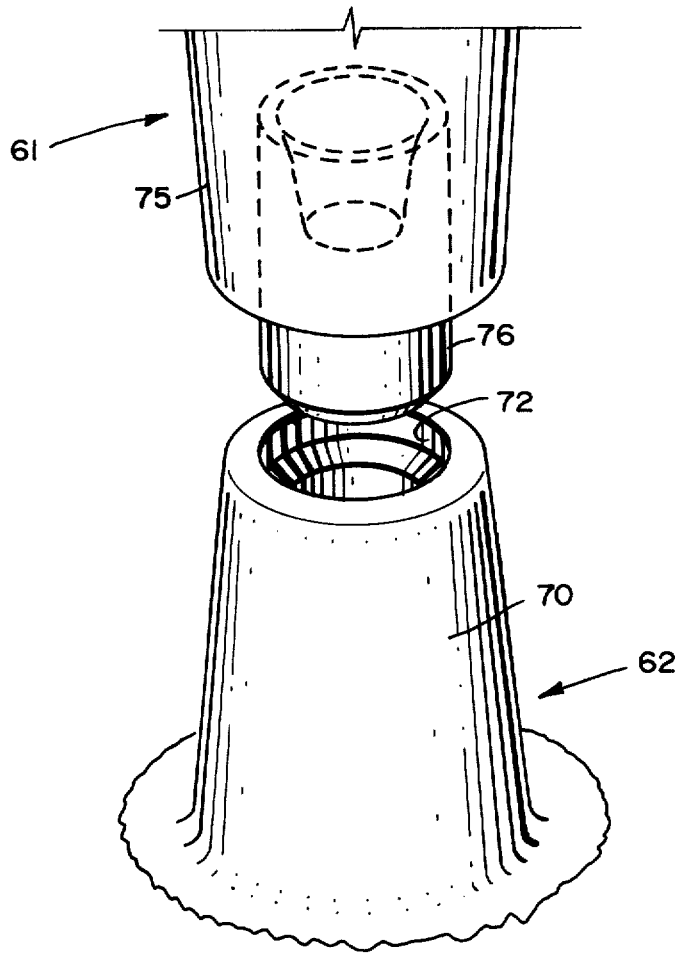
FIG. 5 is a perspective view of the electrodes and contact member of the interrupter shown in FIG. 4.

Another embodiment of the invention is shown in FIGS. 4 and 5. In this embodiment, interrupter 59 includes a housing 60 which is substantially cylindrical in shape and encloses a pair of electrodes 61 and 62 supported by end walls 65 and 66. The cylindrical side walls 63 of housing 60 are preferably formed of molded epoxy or ceramic or another suitable insulating material. Electrodes 61 and 62 extend through side walls 63 providing protruding portions 67 and 68, respectively, for interconnection with a power line. Each electrode has a substantially cylindrical portion shown most clearly in FIG. 5 extending inwardly from the end walls coaxial with the axis 69 of housing 60. Cylindrical portion 70 of electrode 62 encloses a chamber 71. Electrode 62 further includes an opening 72 at its upper end forming a passage between chamber 71 and the interior 73 of housing 60. As in the first embodiment, the interior 73 of the housing, including chamber 71, is filled with a suitable dielectric fluid such as oil or liquid $SF_6$. To minimize the amount of liquid which must be moved during opening, resilient compressible foam members 74 are provided near passage 72 within housing 60. Foam members 74 are preferably formed of a closed cell polyurethane material.

Cylindrical portion 75 of electrode 61 movably supports a contact member 76. Contact 76 is slidably disposed in an opening 77 through the base of electrode 61, and is thereby supported for movement. When contact 76 is in its closed position, as illustrated with solid lines in FIG. 3, it fits within opening 72 in electrode 62, blocking and closing passage 72. In the closed position contact 76 provides a conductive path between electrodes 61 and 62. Contact 76 is also movable to a fully open position resting against stops 78, as illustrated with broken lines in FIG. 4, and in FIG. 5. In its open position, contact 76 is separated from only one electrode (62) and remains in contact with electrode 61. When in either position, contact member 76 remains in conductive contact with electrode 61 and thus serves as a movable contact portion of electrode 61. In effect, contact 76 functions as a movable electrode member interconnected with the power line by means of electrode 61. Electrode 62 functions as a fixed electrode from which the movable electrode formed by electrode portion 61 and contact portion 76 is separable to induce current interruption.

As in the first embodiment, piston 80 provides means in the housing for rapidly increasing the pressure of the liquid in chamber 71. A chemical propellant 81 is provided between piston 80 and housing cap 82 for driving piston 80 against the liquid upon a signal over wire 83.

In operation, the interrupter of FIGS. 4 and 5 is installed on line in the same manner as the first embodiment. Electrode portions 67 and 68 are connected to a power line in parallel with an impedance. During normal operations contact 76 is in its closed position and current flows freely between electrodes 61 and 62. When a rapid rise in current through the interrupter indicates a line fault, the previously-mentioned actuating means sends a detonation signal over wire 83, initiating the opening of the interrupter. Chemical propellant 81 is ignited, driving piston 80 against the liquid in chamber 71 to rapidly increase the pressure of the liquid. The resultant increase in pressure drives contact 76 upwardly in the direction of arrow 84, breaking the continuous current path and causing arcing between electrode 62 and both contact 76 and electrode 61. As before, the pressurized liquid in chamber 71 opens passage 72 causing the liquid to escape into the remainder of housing 60 by way of transverse flow across the arcing gap separating the electrodes. Evantually, contact 76 is driven to a rest position against stops 76. Foam members 74 are compressed as the liquid from chamber 71 enters the housing, reducing back pressure and absorbing some of the pressure pulse in the housing. Because the foam members are located near the point where liquid from chamber 71 enters interior 73, the volume of liquid moved in the housing is minimized. It is intended that sufficient friction will exist between contact 76 and opening 77 in electrode 61 to prevent return of the contact to its closed position. Alternatively, suitable latching means could be provided, as in the first embodiment.

The embodiment of FIGS. 4 and 5 provides for a pair of relatively movable electrode members. One electrode is electrode 61 together with contact 76, and the other is electrode 62. The electrodes are relatively movable into mutual contact when in their closed position to complete a current path. The electrodes are separable by means of liquid flowing through passage 72, as described above.

The embodiment shown in FIGS. 4 and 5 provides for large voltage drops between the electrodes in a manner similar to the first embodiment. Unlike the first embodiment, the contact member becomes separated from ohly one of the two electrodes causing a single break in the current flow. The cylindrical shape of the electrodes provides additional arcing surface. Resilient foam members 74 reduce the volume of fluid which must be transported by the force of the explosive, thus conserving energy. Re-use of the interrupter will generally require replacement of movable contact 76 as well as the propellant charge.

Figure 6:
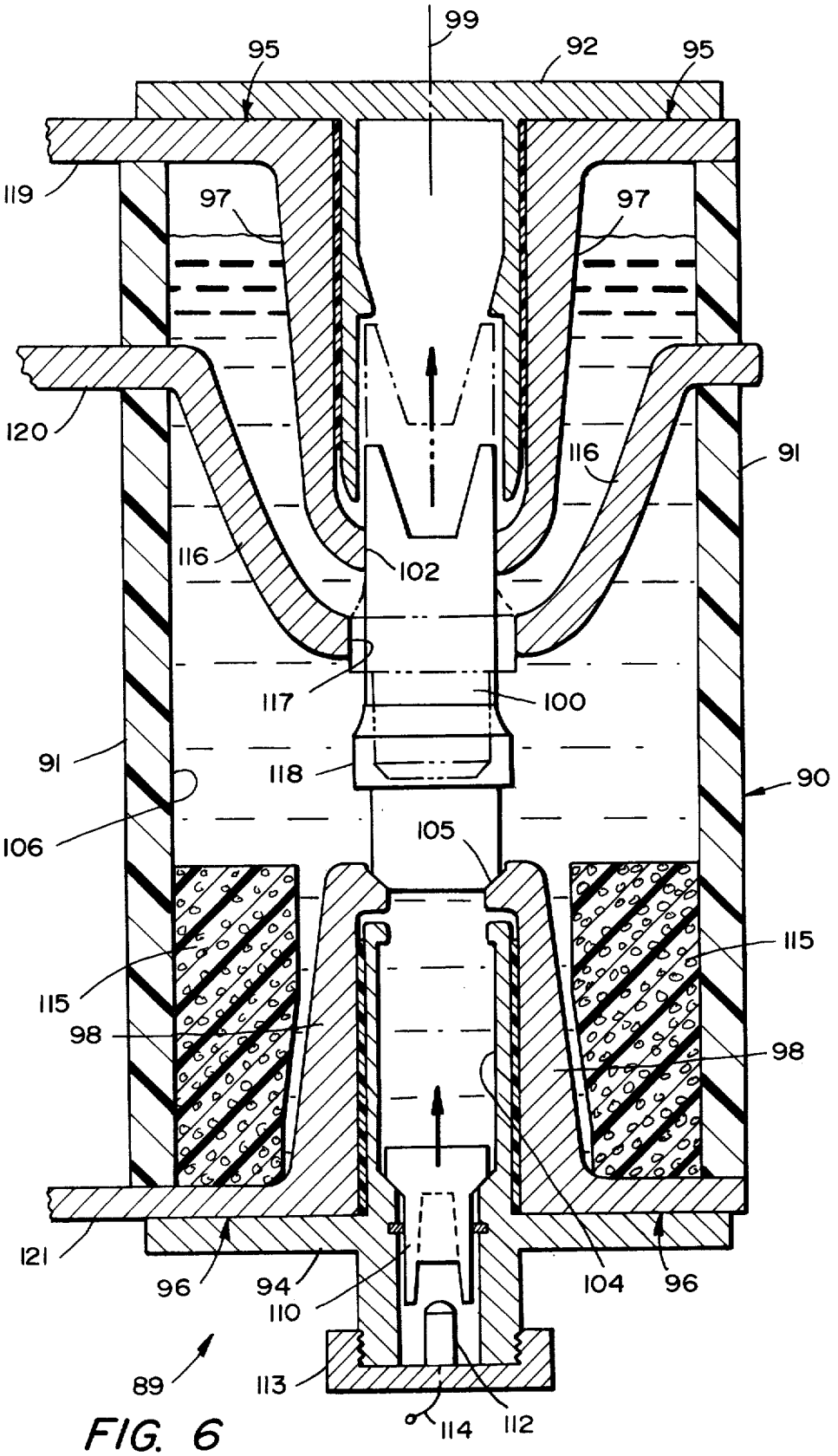
FIG. 6 is a cross-sectional view of another embodiment of the interrupter of FIG. 1.

Another embodiment of the invention is shown in FIG. 6. Interrupter 89 of this embodiment has a substantially cylindrical housing 90 having side walls 91 formed of an insulating material and end walls 92 and 94. In this embodiment, a pair of electrode members 95 and 96 are supported by end walls 92 and 94. As in the embodiment of FIGS. 4 and 5, electrodes 95 and 96 have substantially cylindrical portions 97 and 98, respectively, extending inwardly and coaxial with axis 99 of housing 90. Cylindrical portions 97 and 98 are substantially the same as portions 75 and 70 shown in FIG. 5. Portion 97 of electrode 95 movably supports a contact member 100 in an opening 102, providing a sliding contact. Portion 98 of electrode 96 encloses a chamber 104 and has an opening 105 forming a passage between chamber 104 and the interior 106 of housing 90. As in previous embodiments, interior 106 and chamber 104 are substantially filled with a suitable dielectric fluid such as oil or liquid $SF_6$. When contact 100 is in its closed position, as illustrated with solid lines in FIG. 6, it fits within opening 105 of electrode 96, blocking and closing the passage. To provide means for rapidly increasing the pressure of the liquid in chamber 104 to move contact member 100, a piston 110 is disposed in chamber 104. A chemical propellant 112 is provided between piston 110 and the bottom cap 113 of housing 90 to drive the piston against the liquid. Wire 114 carries the detonation signal. As before, closed-cell resilient foam members 115 minimize the volume of liquid transported by the force of the explosive.

In addition to the pair of electrodes 95 and 96, a third electrode 116 is disposed in housing 90. Electrode 116 also has an opening 117 therethrough which is larger than opening 102 of electrode 95. Consequently, third electrode 116 remains electrically separated from both the other electrodes when contact member 100 is in its closed position. When contact member 100 is shifted to its fully open position, as illustrated with broken lines in FIG. 4, enlarged portion 118 engages opening 117 causing electrode 95 to be electrically interconnected with third electrode 116. Movement of contact 100, therefore, breaks one connection and forms another.

Figure 7:
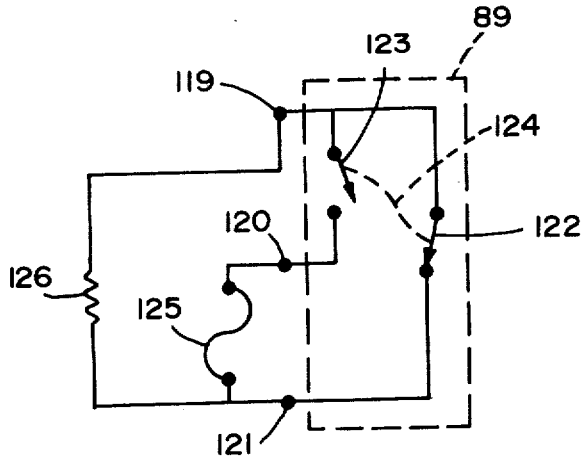
FIG. 7 is a circuit diagram showing the external connections for the interrupter embodiment shown in FIG. 6.

Use of this interrupter is illustrated in FIG. 7. Connection points 119, 120 and 121 represent the protruding portions of electrodes 95, 116 and 96, respectively. The pair of switches 122 and 123, with a mechanical linkage 124 between them, represent the dual switching function of the interrupter of FIG. 4. After the opening of switch 122, which occurs when contact member 100 moves upward and is separated from electrode 96, switch 123 is closed, connecting points 119 and 120. This permits insertion into the line of an additional element such as fuse 125. Resistor 126 in FIG. 7 represents the parallel current-suppressive impedance employed in current-limiting circuits.

Operation of the embodiment of FIG. 6 is according to the same method as the embodiment shown in FIGS. 4 and 5. The interrupter is installed on line with portions 119 and 121 connected to the power line. During normal current flow, contact member 100 remains in its closed position connecting electrodes 95 and 96. As before, apparatus (not shown) monitors line current and when a rapid rise in current indicates a fault, the apparatus initiates the opening method of the invention. Chemical explosive 112 is detonated by a signal on line 114, causing piston 110 to be forced against the liquid in chamber 104. Pressurized liquid immediately exerts pressure on contact 100, driving the contact from opening 105 and initiating arcing between contact 100 and electrode 96. As the liquid in chamber 106 escapes, there is a transverse flow across the arcing gap separating the electrodes, increasing the voltage drop between the arcing electrodes. Resilient foam members 115 absorb the initial pulse pressure in the housing as in the previous embodiment. The force provided by the propellant is sufficient to drive contact 100 up to its fully open position, establishing contact between electrode 95 and third electrode 116. When this embodiment of the invention is installed as shown in FIG. 7, it is contemplated that the insertion of fuse 125 onto the line will minimize commutating duty on switch 122 and facilitate arc interruption. Operation of fuse 125 will serve to divert current into parallel current-suppressive impedance 126.

As in the embodiment of FIGS. 4 and 5, contact 100 and electrode 95 together function as a movable electrode member of opposite polarity to electrode 96. When the movable electrode is separated from fixed electrode 96, arcing occurs in the intervening gap. Given the wide separation between electrodes 95 and 96, substantially all the arcing occurs between electrode 96 and contact 100. Also as in FIGS. 4 and 5, the electrodes 95 and 96, and contact 100, function as a relatively movable electrode pair.

Figure 8:
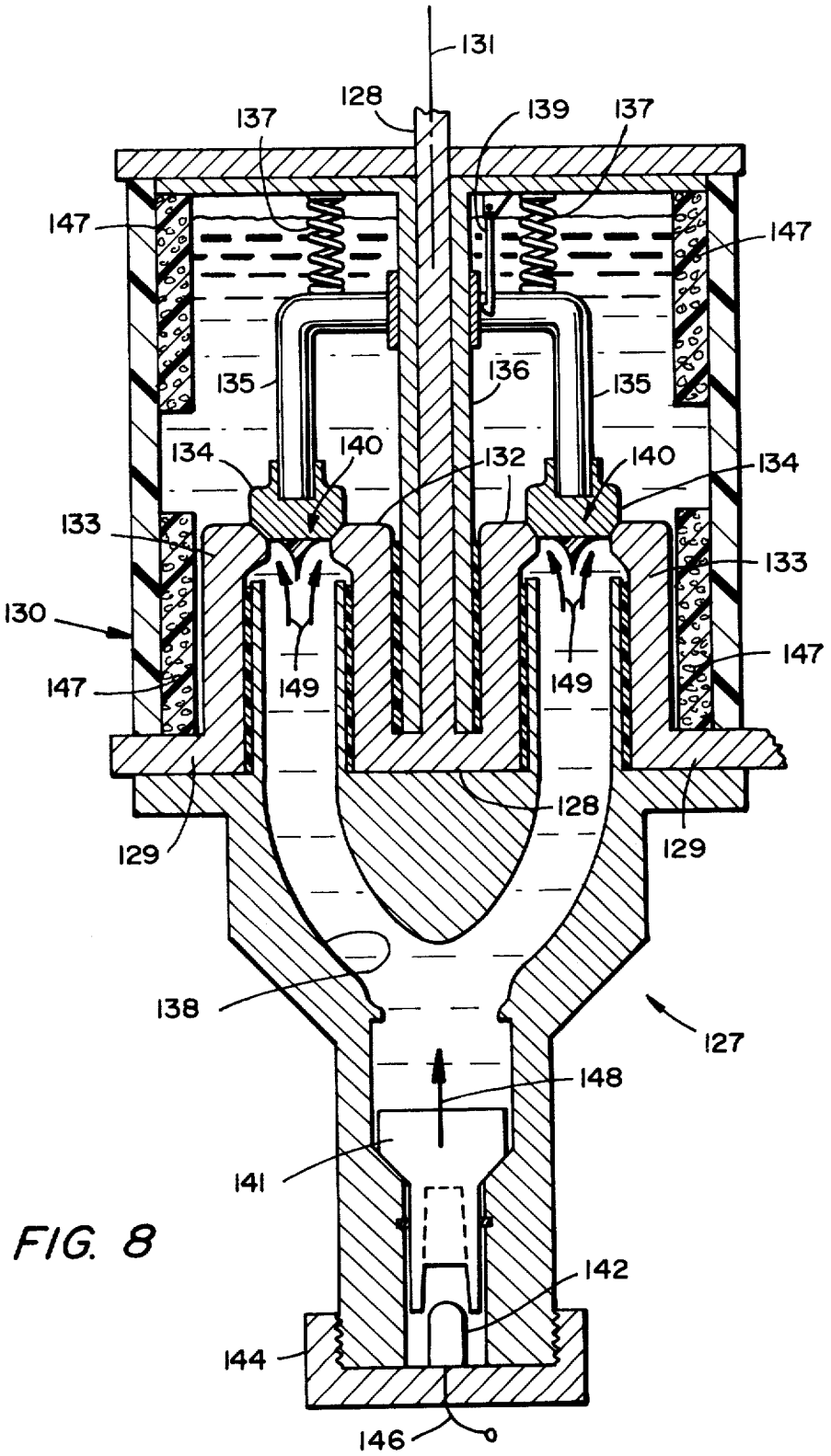
FIG. 8 is a cross sectional view of another embodiment of the interrupter of FIG. 1.
Figure 9:
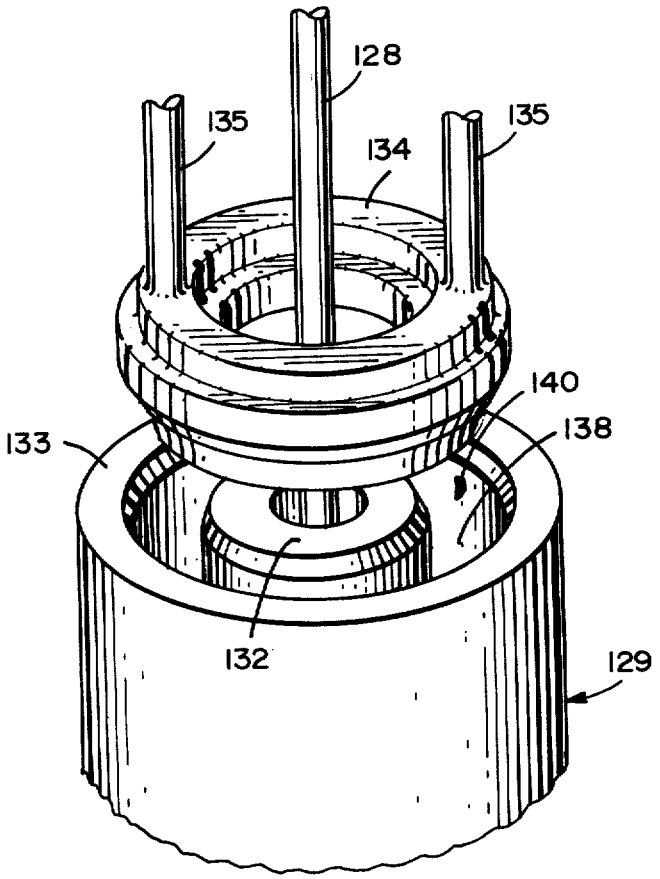
FIG. 9 is a perspective view of the electrodes and contact member of the interrupter shown in FIG. 8.

Another embodiment of a current interrupter according to the invention is shown in FIGS. 8 and 9. In this embodiment, interrupter 127 includes a pair of substantially ring-shaped electrode members 128 and 129 disposed in a housing 130. Electrodes 128 and 129 are concentric with axis 131 of the housing, as is shown most clearly in FIG. 9. Both electrodes include a portion which protrudes from the housing for interconnection with a power line. Each electrode has a ring-shaped contact head. Together the heads form concentric circles around axis 131. Head portion 132 of electrode 128 has a smaller radius and is inside head portion 133 of electrode 129. A substantially ring-shaped contact member 134 is supported for movement in housing 130. The support includes arms 135 slidably engaging the central shaft 136 of the housing. A biased latch 139 is provided, as in the first embodiment. Contact 134 is shown in its closed position in FIG. 8, in which it contacts both electrodes 128 and 129 to provide a conductive path therebetween. Spring means 137 hold the contact in its closed position. FIG. 9 shows contact 134 in its fully opened position, separated from both electrodes 128 and 129.

Extending between electrodes 128 and 129, below head portions 132 and 133 and contact 134, is a chamber 138 in housing 130. Chamber 138 is substantially annular in shape, tapering downward to a single column in the lower portion of the housing. A passage 140 between chamber 138 and the interior of the housing is provided between the head portions 132 and 133 of the electrodes, with the passage being substantially ring-shaped. Contact member 134 blocks and closes passage 140 when in its closed position. As in the previous embodiments, housing 130, including chamber 138, is filled with a suitable dielectric fluid such as oil or liquid $SF_6$. Piston 141 provides means in the housing for rapidly increasing the pressure of the liquid in chamber 138. A chemical propellant 142 between piston 141 and cap 144 serves to drive the piston against the liquid. The detonating signal is carried on wire 146. Resilient foam members 147 absorb the initial pulse pressure as in previous embodiments.

In operation, the interrupter shown in FIGS. 8 and 9 is installed on line in a power distribution system with a parellel current-suppressive impedance as in the previous embodiments. Apparatus (not shown) monitors line current and when a rapid rise in current indicates a fault, the opening method of the invention is initiated. The monitoring apparatus detonates propellant 142 using line 146, causing piston 138 to move upwardly as indicated by arrow 148. Such movement causes a rapid increase in pressure in the chamber which drives contact member 134 from its closed position against the force of springs 137. The flow of liquid proceeds through passage 140, as indicated by arrows 149. Arcing occurs in between both head portions 132 and 133, and contact 134. Liquid escaping from chamber 138 produces a transverse flow across the ring-shaped arcing gaps separating contact 134 from the electrodes, producing a large voltage drop between the arcing electrodes to divert the current into the parallel impedance. As in the embodiments of FIGS. 4–7, foam members 147 are compressed by the pressure of the liquid entering the housing. Latch 139 prevents a reclosure of the contact following separation.

The embodiment shown in FIGS. 8 and 9 provides large contact surfaces which allow for high continuous current carrying capability. Nevertheless, all points of the arcing gap are subjected to strong dielectric liquid cross-flow from the annular fluid chamber. Replacement of the explosive charge 142 and replacing and resetting contact 130 permit re-use of this embodiment of the interrupter.

The current interrupter and method of this invention provides improved voltage drop characteristics for use in diverting fault currents into a parallel current-suppressive impedance. The use of a fluid column to drive the electrodes apart, or move a bridging contact, provides an extremely efficient and fast-acting actuating mechanism. Furthermore, the resultant cross-flow of dielectric fluid across the arcing gap helps cool the electrodes and increase the voltage drop between the arcing electrodes. The use of a chemical propellant provides extremely high driving forces for the movable piston and can separate the movable contact from the electrodes in less than one millisecond.

Other embodiments of current interrupters are possible within the scope of the invention. The electrodes may assume other shapes, for example. Likewise, the chamber containing the column of dielectric fluid can assume different shapes to accommodate alternative locations for the driving piston. Dielectric gases such as air can be used to transmit the opening force to drive the electrodes apart. The addition of further contact electrodes, such as the third electrode shown in FIG. 6, is also possible.

A current interrupter and method has been provided for a fault current limiter which is both fast-acting and causes a large voltage drop between the arcing electrodes. The invention employs chemical propellants to open movable contacts. In addition, a strong transverse flow of dielectric fluid is provided across the arcing gap of the interrupter.

What is claimed is:

1. A current interrupter for use in controlling current associated with power line faults comprising: a housing, a pair of electrode members fixed in spaced relation in said housing, a contact member supported in said housing for movement between closed and open positions, said contact member being electrically interconnected with one of said pair of electrode members at all times and being in electrical contact with the other of said pair of electrode members when in said closed position and spaced from said other of said pair of electrode members when in said open position, a third electrode member fixed in said housing and spaced from both said pair of electrode members, said contact member being spaced from said third electrode member when in said closed position and being in electrical contact with said third electrode member to interconnect said third electrode member with said one of said pair of electrode members when in said open position, a chamber in the interior of said housing for holding a dielectric fluid, a passage between said chamber and the interior of said housing, said contact member blocking and closing said passage when in said closed position, and means in said housing for rapidly incresing fluid pressure in said chamber to force escape of said dielectric fluid through said passage and thereby move said contact member from said closed position to said open position by means of fluid pressure.

2. A current interrupter as in claim 1 in which said chamber is filled with a dielectric liquid.

3. A current interrupter as in claim 2 in which said dielectric liquid is liquid sulfur hexafluoride.

4. A current interrupter as in claim 2 in which one said electrode member has an opening therethrough forming said passage.

5. A current interrupter as in claim 1 in which said means in said housing for rapidly increasing fluid pressure includes a piston in said chamber and a chemical propellant for driving said piston.

6. A current interrupter as in claim 1 in which each said electrode member of said pair of electrode members are substantially cylindrical in shape and are disposed along a common axis, said one of said pair of electrode members having an opening therethrough in which said contact member is supported for slidable movement between said closed and open positions.

7. A current interrupter as in claim 6 in which said third electrode member has an opening therethrough through which said contact member extends, said contact member having an engaging portion which contacts and engages said third electrode member at said opening through said third electrode member when said contact member is in said open position, said contact member including said engaging portion being spaced from said third electrode member when in said closed position.

8. A method of opening a current interrupter of the type having a pair of electrode members fixed in spaced relation, a contact member supported for movement between closed and open positions, wherein said contact member is electrically interconnected with one of said pair of electrode members at all times and is in electrical contact with the other of said pair of electrode members when in said closed position and is spaced from said other of said pair of electrode members when in said open position, means forming a fluid chamber having a passage providing an outlet from said chamber, said chamber containing dielectric fluid, said contact member blocking and closing said passage when in said closed position, said method comprising the steps: increasing the fluid pressure in said chamber by an amount sufficient to drive said contact member from said closed position and also to drive said contact member into electrical contact with a third electrode member thereby interconnecting said third electrode member with said one of said pair of electrode members, and causing said fluid to escape said chamber through said passage by way of transverse flow through the gap separating said contact member and said other of said pair of electrode members whereby an arc in said gap is subjected to a transverse flow of said dielectric fluid.

9. The method of claim 8 in which said current interrupter includes a piston in said chamber and a chemical propellant for driving said piston, and in which said step of increasing the fluid pressure in said chamber includes igniting said chemical propellant to drive said piston against said dielectric fluid in said chamber.

* * * * *